US007139712B1

(12) United States Patent
Yamada

(10) Patent No.: US 7,139,712 B1
(45) Date of Patent: Nov. 21, 2006

(54) SPEECH SYNTHESIS APPARATUS, CONTROL METHOD THEREFOR AND COMPUTER-READABLE MEMORY

(75) Inventor: Masayuki Yamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/263,262

(22) Filed: Mar. 5, 1999

(30) Foreign Application Priority Data

Mar. 9, 1998 (JP) ..... 10-057249

(51) Int. Cl.
*G10L 13/06* (2006.01)

(52) U.S. Cl. ..... 704/266

(58) Field of Classification Search ..... 704/258–269
See application file for complete search history.

(56) References Cited

U.S. PATENT DOCUMENTS

| | | | | |
|---|---|---|---|---|
| 4,979,216 A | | 12/1990 | Malsheen et al. | 704/260 |
| 5,636,325 A | * | 6/1997 | Farrett | 704/267 |
| 5,659,664 A | * | 8/1997 | Kaja | 704/266 |
| 5,787,396 A | | 7/1998 | Komori et al. | 704/256 |
| 5,797,116 A | | 8/1998 | Yamada et al. | 704/10 |
| 5,913,193 A | * | 6/1999 | Huang et al. | 704/258 |
| 6,163,769 A | * | 12/2000 | Acero et al. | 704/266 |

FOREIGN PATENT DOCUMENTS

| | | |
|---|---|---|
| EP | 0 805 433 A2 | 11/1997 |
| JP | 7-319497 | 12/1995 |
| WO | WO 95/04988 | 2/1995 |

OTHER PUBLICATIONS

Hirokawa, et al., "High Quality Speech Synthesis System Based on Waveform Concatenation of Phoneme Segment," Inst. Of Electronics Information and Comm., Eng., Tokyo, vol. 76A, No. 11, pp. 1964-1970 (the whole document).

Blomberg, M., et al., "Creation of Unseen Triphones from Diphones and Monophones Using a Speech Production Approach," Proceedings 4th International Conf. on Spoken Language Processing, Oct. 3-6, 1996, pp. 2316-2319, vol. 4.

* cited by examiner

*Primary Examiner*—David D. Knepper
(74) *Attorney, Agent, or Firm*—Fitzpatrick, Cella, Harper & Scinto

(57) ABSTRACT

A second phoneme is generated in consideration of a phonemic context with respect to a first phoneme as a search target. Phonemic piece data corresponding to the second phoneme is searched out from a database. A third phoneme is generated by changing the phonemic context on the basis of the search result, and phonemic piece data corresponding to the third phoneme is re-searched out from the database. The search or re-search result is registered in a table in correspondence with the second or third phoneme.

27 Claims, 9 Drawing Sheets

FIG. 5

| MEAN F0 | 98.3 | 130.7 | 240.4 | ... | 320.2 | 403.4 |
|---|---|---|---|---|---|---|
| PHONEMIC PIECE POSITION | 14386 | 20056 | 23580 | ... | 30524 | 34216 |

SPEECH SYNTHESIS APPARATUS, CONTROL METHOD THEREFOR AND COMPUTER-READABLE MEMORY

BACKGROUND OF THE INVENTION

The present invention relates to a speech synthesis apparatus, which has a database for managing phonemic piece data and performs speech synthesis by using the phonemic piece data managed by the database, a control method for the apparatus, and a computer-readable memory.

As a conventional speech synthesis method, a synthesis method based on a waveform concatenation scheme is available. In the waveform concatenation synthesis method, the prosody is changed by the pitch synchronous waveform overlap adding method of pasting waveform element pieces corresponding to one or more pitches at desired pitch intervals. The waveform concatenation synthesis method can obtain more natural synthetic speech than a synthesis method based on a parametric scheme, but suffers the problem of a narrow allowable range with respect to changes in prosody.

Under the circumstances, attempts are made to improve the speech quality by preparing various speech data and properly selecting and using them. As a criterion for selection of speech data, information such as phonemic context (a phoneme to be synthesized or a few phonemes on two sides of the target phoneme) or fundamental frequency F0 is used.

The following problems are, however, posed in the above conventional speech synthesis method.

If, for example, there is no data that satisfies a phonemic context as a synthesis target, a search for necessary speech data is made again by relaxing the condition associated with the phonemic context. The execution of this re-search in speech synthesis complicates the processing, resulting in an increase in processing time. In addition, when the fundamental frequency F0 is to be used as a criterion for selection of speech data, each speech data must be evaluated in association with the fundamental frequency F0 to obtain speech data that matches most with the fundamental frequency F0 of the speech data to be synthesized.

SUMMARY OF THE INVENTION

The present invention has been made in consideration of the above problems, and has as its object to provide a speech synthesis apparatus capable of performing speech synthesis with high precision at high speed, a control method therefor, and a computer-readable memory.

In order to achieve the above object, a speech synthesis apparatus according to the present invention has the following arrangement. There is provided a speech synthesis apparatus having a database for managing phonemic piece data comprising a generating means, a search means, a research means, and a registration means. The generating means is for generating a second phoneme in consideration of a phonemic context for a first phoneme as a search target. The search means is for searching the database for a phonemic piece data corresponding to the second phoneme. The re-search means is for generating a third phoneme by changing the phonemic context on the basis of the search result obtained by the search means, and re-searching the database for phonemic piece data corresponding to the third phoneme. The registration means is for registering the search result obtained by the search means or the re-search means in a table in correspondence with the second or third phoneme.

In order to achieve the above object, there is also provided a speech synthesis apparatus for performing speech synthesis by using phonemic piece data managed by a database, comprising a storage means for storing a table for managing position information indicating a position of phonemic piece data in the database in correspondence with a phoneme obtained in consideration of a phonemic context made to correspond to the phonemic piece data. The speech synthesis apparatus also comprises a calculation means for acquiring each phonemic context information of a phoneme group as a synthesis target and fundamental frequencies corresponding thereto and calculating an average of acquired fundamental frequencies and a search means for searching a phoneme group corresponding to the phonemic context information from the table. Additionally, the apparatus comprises an acquisition means for acquiring, from the table, position information of phonemic piece data corresponding to a predetermined phoneme of the phoneme group searched out by the search means, on the basis of the average of fundamental frequencies calculated by the calculation means and a changing means for acquiring phonemic piece data indicated by the position information acquired by the acquisition means from the database, and changing a prosody of the acquired phonemic piece data.

In order to achieve the above object, there is also provided a control method for a speech synthesis apparatus having a database for managing phonemic piece data, comprising a generating step, a search step, a re-search step, and a registration step.

The generating step is for generating a second phoneme in consideration of a phonemic context for a first phoneme as a search target. The search step is for searching the database for a phonemic piece data corresponding to the second phoneme. The re-search step is for generating a third phoneme by changing the phonemic context on the basis of the search result obtained in the search step, and re-searching the database for phonemic piece data corresponding to the third phoneme. Finally, the registration step is for registering the search result obtained in the search step or the re-search step in a table in correspondence with the second or third phoneme.

In order to further achieve the above object, a control method for a speech synthesis apparatus according to the present invention has the following steps. There is provided a control method for a speech synthesis apparatus for performing speech synthesis by using phonemic piece data managed by a database. The control method includes storing a table for managing position information indicating a position of phonemic piece data in the database in correspondence with a phoneme obtained in consideration of a phonemic context made to correspond to the phonemic piece data and acquiring each phonemic context information of a phoneme group as a synthesis target and fundamental frequencies corresponding thereto and calculating an average of acquired fundamental frequencies. The control method also includes searching a phoneme group corresponding to the phonemic context information from the table and acquiring, from the table, position information of phonemic piece data corresponding to a predetermined phoneme of the phoneme group searched out in the search step, on the basis of the average of the calculated fundamental frequencies. Additionally, the method includes acquiring phonemic piece data indicated by the position information acquired in the acquisition step from the database, and changing a prosody of the acquired phonemic piece data.

To further achieve the above object, a computer-readable memory according to the present invention has the following program codes. There is provided a computer-readable memory storing program codes for controlling a speech synthesis apparatus having a database for managing phonemic piece data. The computer-readable memory includes a program code for generating a second phoneme in consideration of a phonemic context for a first phoneme as a search target and a program code for searching the database for a phonemic piece data corresponding to the second phoneme. The computer-readable memory also includes a program code for generating a third phoneme by changing the phonemic context on the basis of the obtained search result, and re-searching the database for phonemic piece data corresponding to the third phoneme, and a program code for registering the obtained search result in a table in correspondence with the second or third phoneme.

Lastly, to further achieve the above object, a computer-readable memory according to the present invention has the following program codes. There is provided a computer-readable memory storing program codes for controlling a speech synthesis apparatus for performing speech synthesis by using phonemic piece data managed by a database. The computer-readable memory comprises a program code for storing a table for managing position information indicating a position of phonemic piece data in the database in correspondence with a phoneme obtained in consideration of a phonemic context made to correspond to the phonemic piece data and a program code for acquiring each phonemic context information of a phoneme group as a synthesis target and fundamental frequencies corresponding thereto and calculating an average of acquired fundamental frequencies. The computer-readable memory also comprises a program code for searching a phoneme group corresponding to the phonemic context information from the table and a program code for acquiring from the table, position information of phonemic piece data corresponding to a predetermined phoneme of the phoneme group searched out, on the basis of the average of calculated fundamental frequencies. The computer-readable memory additionally includes a program code for acquiring phonemic piece data indicated by the position information acquired from the database, and changing a prosody of the acquired phonemic piece data.

According to the present invention described above, a speech synthesis apparatus capable of performing speech synthesis with high precision at high speed, a control method therefor, and a computer-readable memory can be provided.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 5 is a view showing a table obtained from the index managed in the first embodiment of the present invention;

DETAILED DESCRIPTION OF THE PREFERRED EMBODIMENTS

Figure 1:
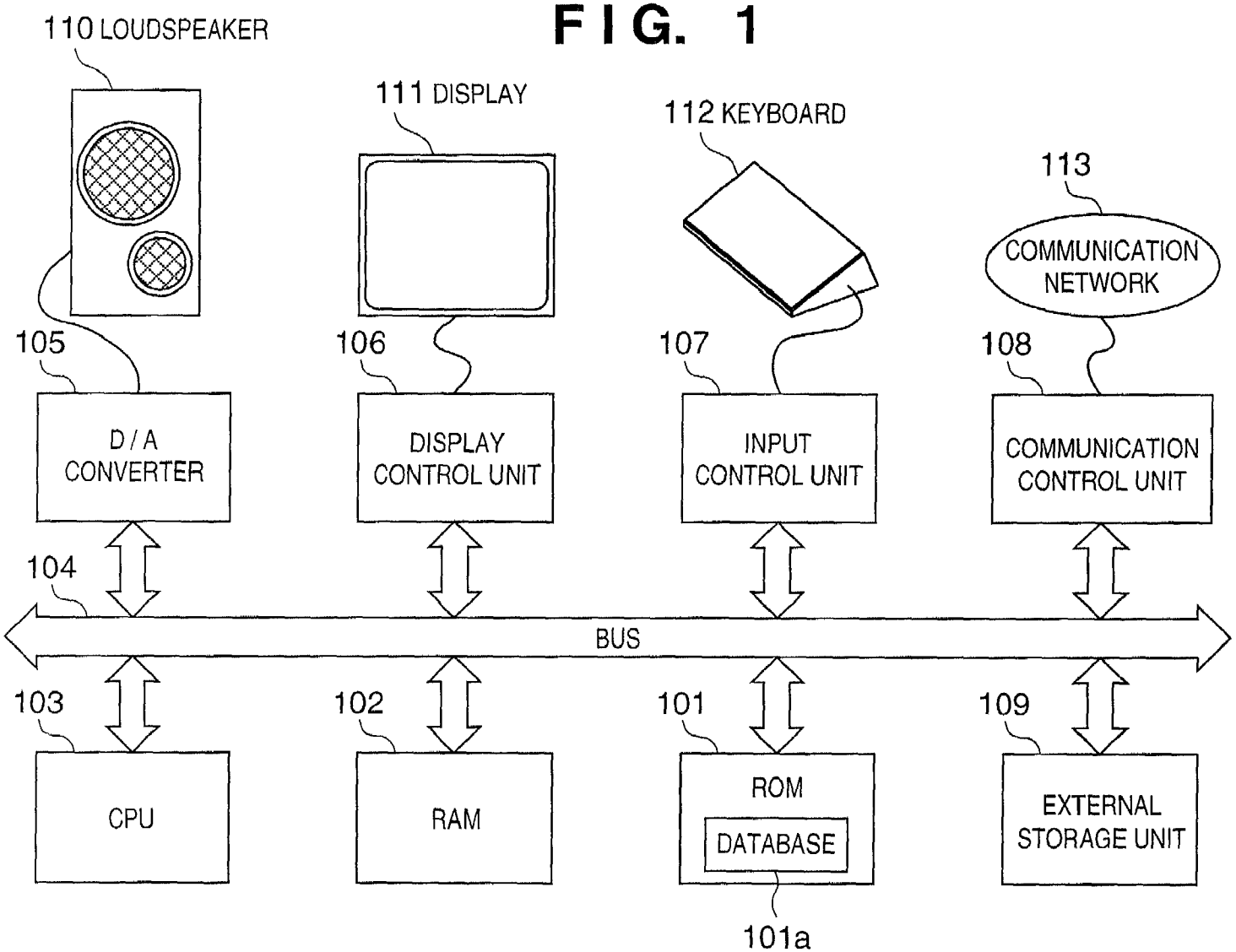
FIG. 1 is a block diagram showing the arrangement of a speech synthesis apparatus according to the first embodiment of the present invention.

FIG. 1 is a block diagram showing the arrangement of a speech synthesis apparatus according to the first embodiment of the present invention.

Reference numeral 103 denotes a CPU for performing numerical operation/control, control on the respective components of the apparatus, and the like, which are executed in the present invention; 102, a RAM serving as a work area for processing executed in the present invention and a temporary saving area for various data; 101, a ROM storing various control programs such as programs executed in the present invention, and having an area for storing a database 101*a* for managing phonemic piece data used for speech synthesis; 109, an external storage unit serving as an area for storing processed data; and 105, a D/A converter for converting the digital speech data synthesized by the speech synthesis apparatus into analog speech data and outputting it from a loudspeaker 110.

Reference numeral 106 denotes a display control unit for controlling a display 111 when the processing state and processing results of the speech synthesis apparatus, and a user interface are to be displayed; 107, an input control unit for recognizing key information input from a keyboard 112 and executing the designated processing; 108, a communication control unit for controlling transmission/reception of data through a communication network 113; and 104, a bus for connecting the respective components of the speech synthesis apparatus to each other.

Search processing of searching for a target phoneme, of the processing executed in the first embodiment, will be described next with reference to FIG. 2.

Figure 2:
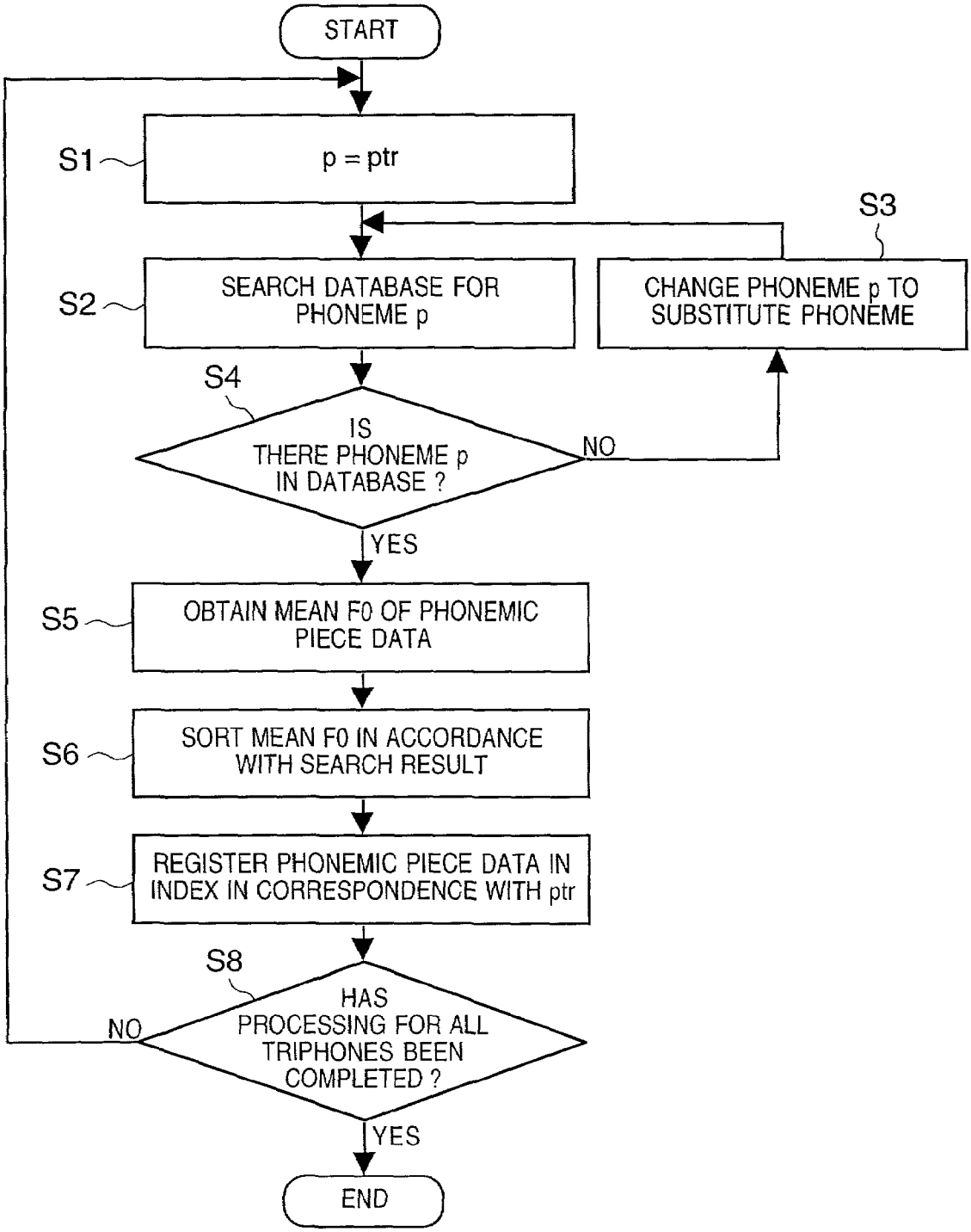
FIG. 2 is a flow chart showing search processing executed in the first embodiment of the present invention.

FIG. 2 is a flow chart showing search processing executed in the first embodiment of the present invention.

In the first embodiment, as phonemic contexts, two phonemes on both sides of each phoneme, i.e., phonemes as right and left phonemic contexts called a triphone, are used.

First of all, in step S1, a phoneme p as a search target from the database 101*a* is initialized to a triphone ptr. In step S2, a search is made for the phoneme p from the database 101*a*. More specifically, a search is made for phonemic piece data having label p indicating the phoneme p. It is then checked in step S4 whether there is the phoneme p in the database 101*a*. If it is determined that the phoneme p is not present (NO in step S4), the flow advances to step S3 to change the search target to a substitute phoneme having lower phonemic context dependency than the phoneme p. If the phoneme p matching with the triphone ptr is not present in the database 101*a*, the phoneme p is changed to the right phonemic context dependent phoneme. If the right phonemic context dependent phoneme does not match with the triphone ptr, the phoneme p is changed to the left phonemic context dependent phoneme. If the left phonemic context dependent phoneme does not match with the triphone ptr, the phoneme p is changed to another phoneme independently of a phonemic context. Alternatively, a high priority may be given to a left phonemic context phoneme for a vowel, and a high priority may be given to a right phonemic context phoneme for a consonant. In addition, if there is no phoneme p that matches with the triphone ptr, one or both of left and right phonemic contexts may be replaced with similar phonemic contexts. For example, the "k" (consonant of the "ka" column in the Japanese syllabary) may be used as a substitute when the right phonemic context is "p" (consonant for the "pa" column which is modified "ha" column in the Japanese syllabary). Note, the Japanese syllabary is the Japanese basic phonetic character set. The character set can be arranged in a matrix where there are five (5) rows and ten (10) columns. The five rows are respectively the five vowels of the English language and the ten rows consist of 9 consonants and the column of the five vowels. A phonetic (sound) character is represented by the sound resulting from combining a column character and a row character, e.g. column "t" and row "e" is pronounced "te"; column "s" and row "o" is pronounced "so". After the phoneme p as the search condition is changed in this manner, the flow returns to step S2.

If it is determined that the phoneme p is present (YES in step S4), the flow advances to step S5 to calculate a mean F0 (the mean of the fundamental frequencies from the start of phonemic piece data to the end). Note that this calculation may be performed with respect to a logarithm F0 (function of time) or linear F0. Furthermore, the mean F0 of unvoiced speech may be set to 0 or estimated from the mean F0 of phonemic piece data of phonemes on both sides of the phoneme p by some method.

Figure 3:
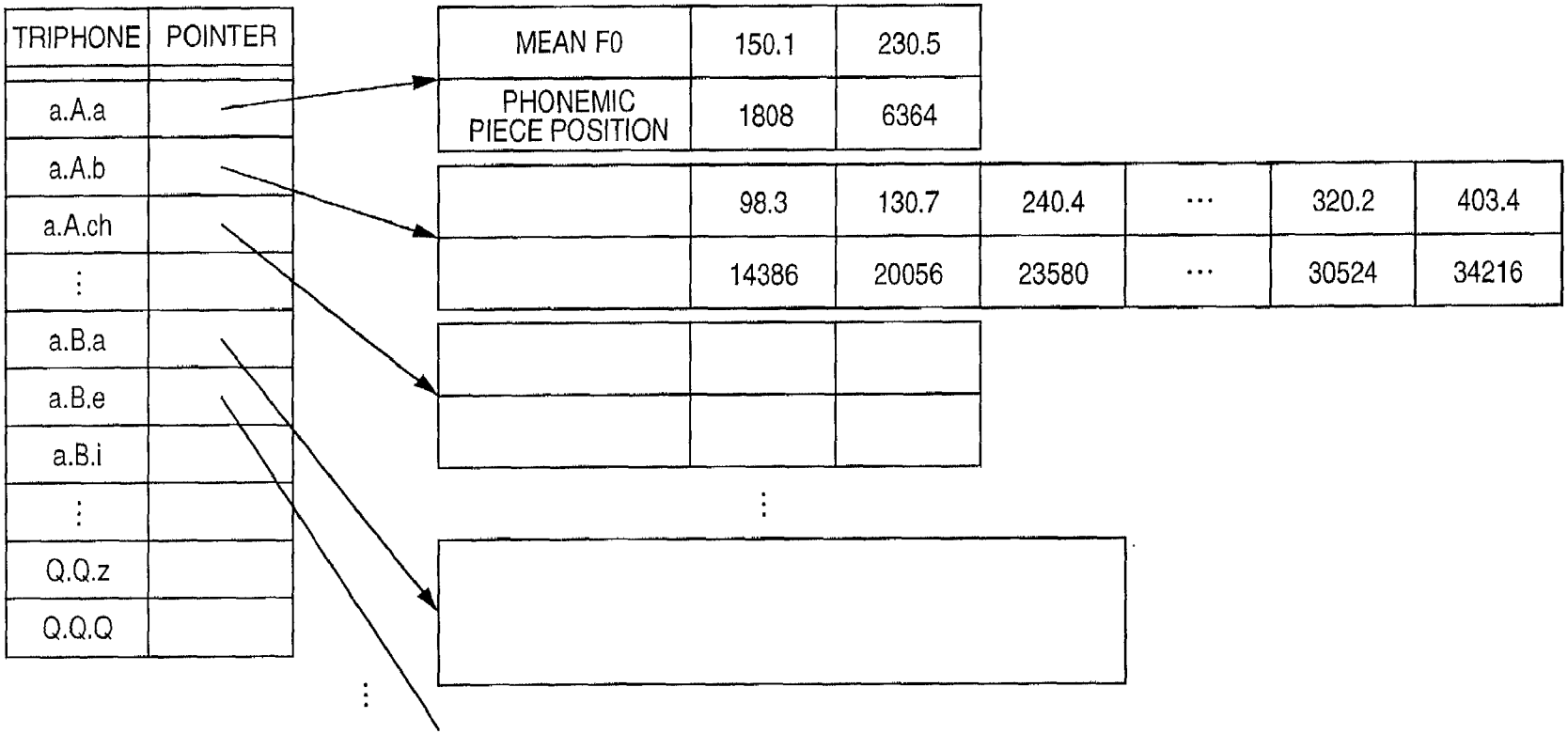
FIG. 3 is a view showing an index managed in the first embodiment of the present invention.

In step S6, the respective searched phonemic piece data are aligned (sorted) on the basis of the calculated mean F0. In step S7, the sorted phonemic piece data are registered in correspondence with the triphone ptr. As a result of registration, an index like the one shown in FIG. 3 is obtained, which indicates the correspondence between generated phonemic piece data and triphones. As shown in FIG. 3, in the pointers managed in correspondence with the triphones, "phonemic piece position" indicating the location of each phonemic piece data in the database 101*a* and "mean F0" are managed in the form of a table.

Steps S1 to S7 are repeated for all conceivable triphones. It is then checked in step S8 whether the processing for all the triphones is complete. If it is determined that the processing is not complete (NO in step S8), the flow returns to step S1. If it is determined that the processing is complete (YES in step S8), the processing is terminated.

Speech synthesis processing of performing speech synthesis by searching for phonemic piece data of a phoneme as a synthesis target using the index generated by the processing described with reference to FIG. 2 will be described next with reference to FIG. 4.

Figure 4:
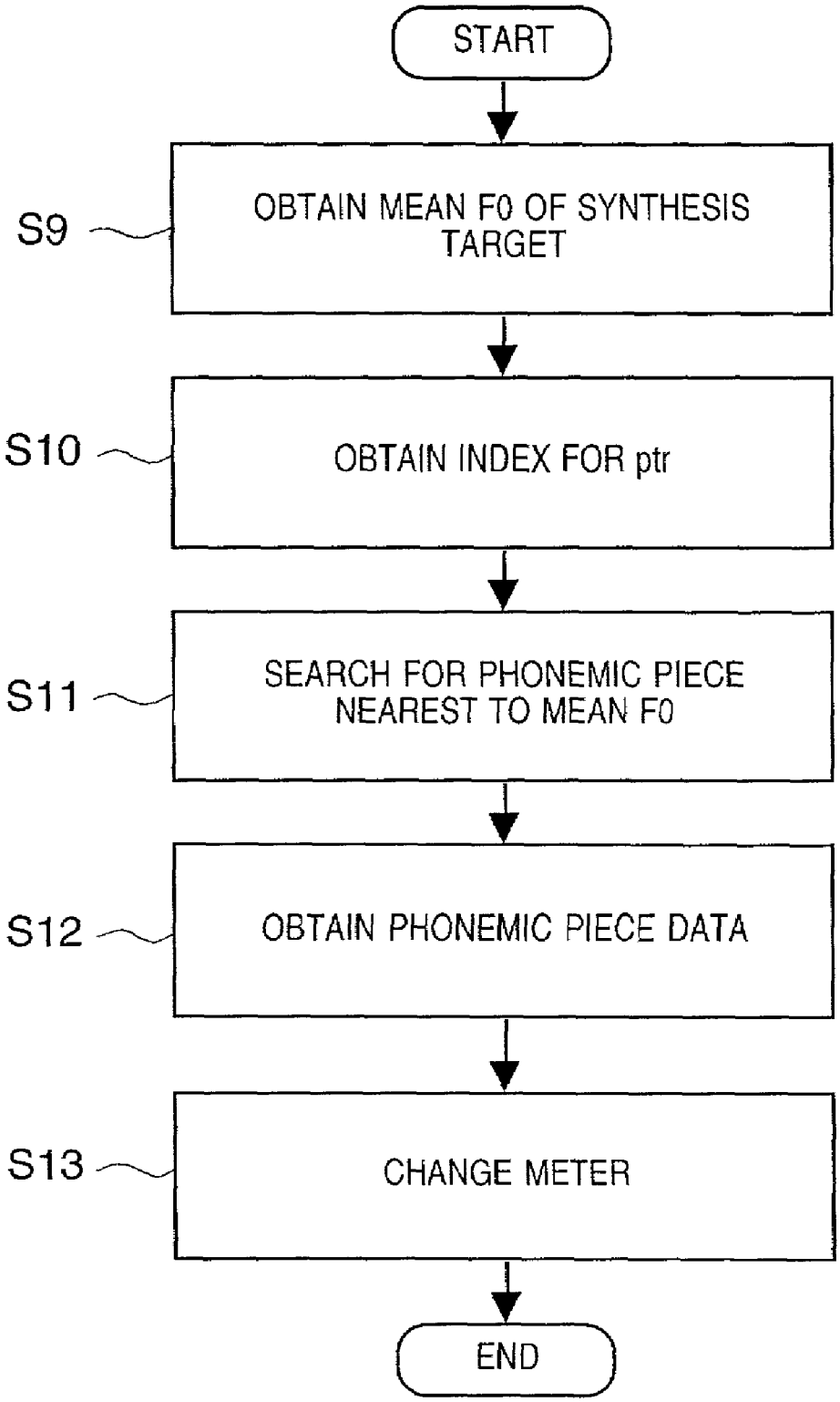
FIG. 4 is a flow chart showing speech synthesis processing executed in the first embodiment of the present invention.

FIG. 4 is a flow chart showing the speech synthesis processing executed in the first embodiment of the present invention.

When speech synthesis processing is to be performed, the triphone context ptr of the phoneme p as a synthesis target and F0 trajectory are given. Speech synthesis is then performed by searching phonemic piece data of phonemes on the basis of mean F0 and triphone context ptr and using the waveform overlap adding method.

First of all, in step S9, mean F0' which is mean of the given F0 trajectory of a synthesis target is calculated. In step S10, a table for managing the phonemic piece position of phonemic piece data corresponding to the triphone ptr of the phoneme p is searched out from the index shown in FIG. 3. If, for example, the triphone ptr is "a. A. b", the table shown in FIG. 5 is obtained from the index shown in FIG. 3. Since proper substitute phonemes have been obtained by the above search processing, the result of this step never becomes empty.

In step S11, the phonemic piece position of phonemic piece data having the mean F0 nearest to the mean F0' is obtained on the basis of the table obtained in step S10. In this case, since the phonemic piece data have been sorted by the above search processing on the basis of mean F0, a search can be made by using a binary search method or the like. In step S12, phonemic piece data is retrieved from the database 101*a* in accordance with the phonemic piece position obtained in step S11. In step S13, the prosody of the phonemic piece data obtained in step S12 is changed by using the waveform overlap adding method.

As described above, according to the first embodiment, when the absence of phonemic piece data is determined after the presence/absence of phonemic piece data is checked with respect to all the conceivable phonemic contexts, the processing is simplified and the processing speed is increased by preparing substitute phonemes in advance. In addition, since information associated with the mean F0 of phonemic piece data present in each phonemic context is extracted in advance, and the phonemic piece data are managed on the basis of the extracted information. This can increase the processing speed of speech synthesis processing.

Second Embodiment

Quantization of the mean F0 of phonemic piece data may replace calculation of the mean F0 of continuous phonemic piece data in step S5 in FIG. 2 in the first embodiment. This processing will be described with reference to FIG. 6.

Figure 6:
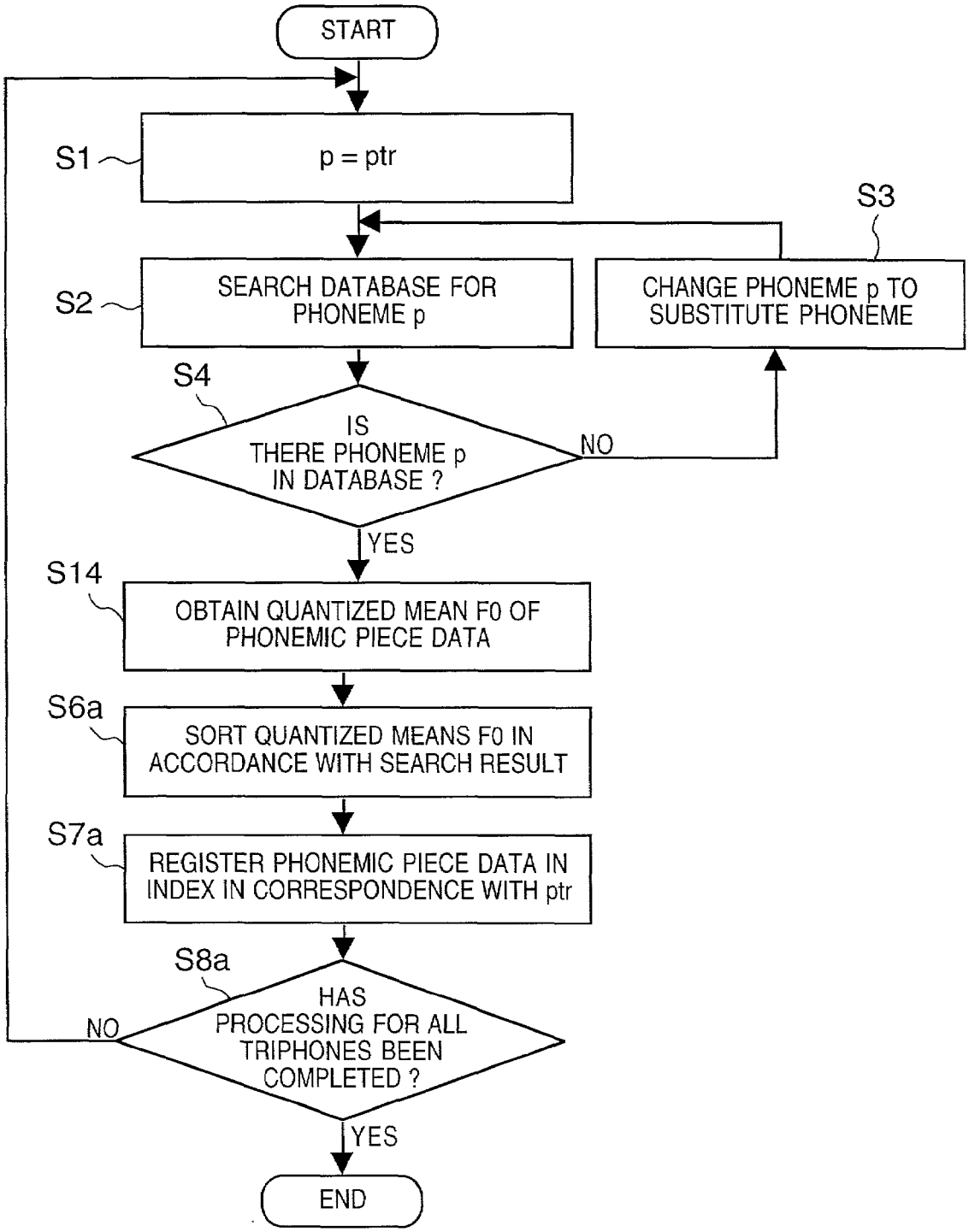
FIG. 6 is a flow chart showing search processing executed in the second embodiment of the present invention.

FIG. 6 is a flow chart showing search processing executed in the second embodiment of the present invention.

Note that the same step numbers in FIG. 6 denote the same processes as those in FIG. 2 in the first embodiment, and a detailed description thereof will be omitted.

In step S14, a mean F0 of the phonemic piece data of searched phonemes p is quantized to obtain the quantized mean F0 (obtained by quantizing the mean F0 as a continuous value at certain intervals). This calculation may be performed for the logarithm F0 or linear F0. In addition, the mean F0 of unvoiced speech may be set to 0, or unvoiced speech may be estimated from the mean F0 of phonemic piece data on both side of the unvoiced speech by some method.

Figure 7:
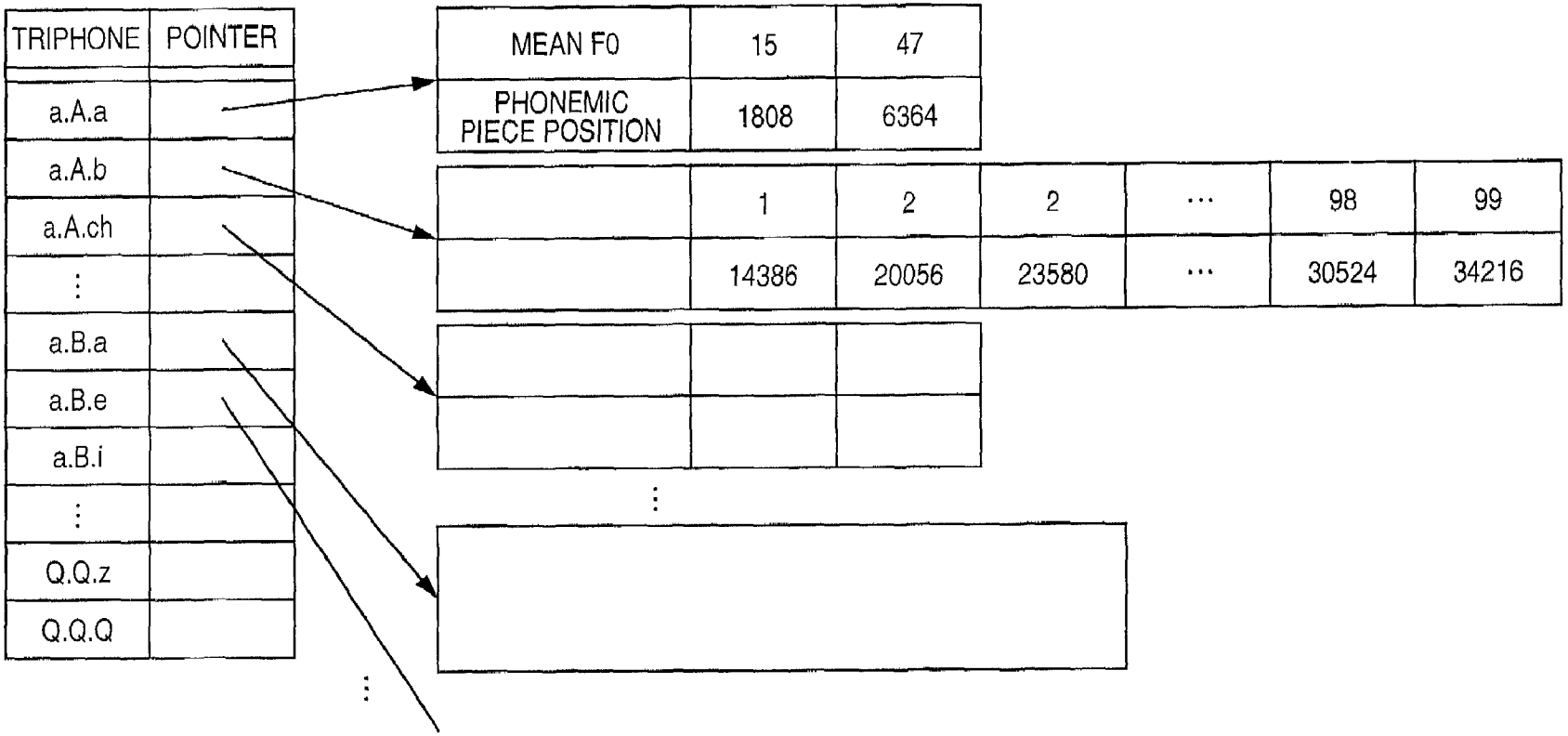
FIG. 7 is a view showing an index managed in the second embodiment of the present invention.

In step S6*a*, the searched phonemic piece data are aligned (sorted) on the basis of the quantized mean F0. In step S7*a*, the sorted phonemic piece data are registered in correspondence with triphones ptr. As a result of registration, an index indicating the correspondence between the generated phonemic piece data and the triphones is formed as shown in FIG. 7. In addition, as shown in FIG. 7, in the pointers managed in correspondence with the triphones, "phonemic piece position" indicating the location of each phonemic piece data in the database 101*a* and "mean F0" are managed in the form of a table.

Steps S1 to S7*a* are repeated for all possible triphones. It is then checked in step S8*a* whether the processing for all the triphones is complete. If it is determined that the processing is not complete (NO in step S8*a*), the flow returns to step S1. If it is determined that the processing is complete (YES in step S8*a*), the processing is terminated.

As described above, according to the second embodiment, in addition to the effects obtained in the first embodiment, the number of phonemic pieces and the calculation amount for search processing can be reduced by using the quantized mean F0 of phonemic piece data.

Third Embodiment

In the second embodiment, after the portions between the sorted phonemic piece data are interpolated, the respective phonemic piece data may be registered in correspondence with the triphones ptr. That is, an arrangement may be made such that phonemic piece positions corresponding to the quantized means F0 of all the quantized phonemic piece data can be searched out in the tables in the index. This processing will be described with reference to FIG. 8.

Figure 8:
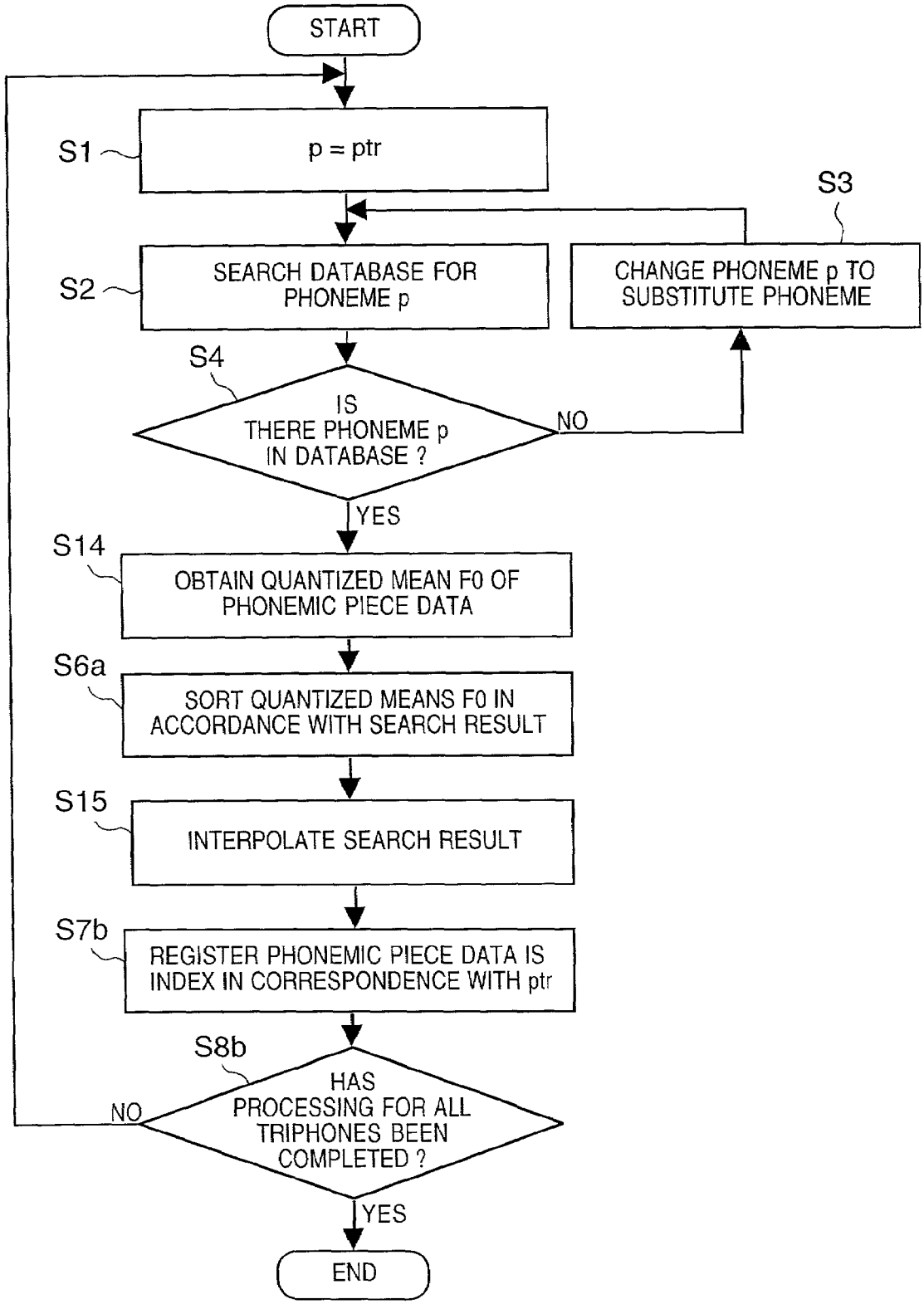
FIG. 8 is a flow chart showing search processing executed in the third embodiment of the present invention.

FIG. 8 is a flow chart showing search processing executed in the third embodiment of the present invention.

Note that the same step numbers in FIG. 8 denote the same processes as those in FIG. 6 in the second embodiment, and a detailed description thereof will be omitted.

Figure 9:
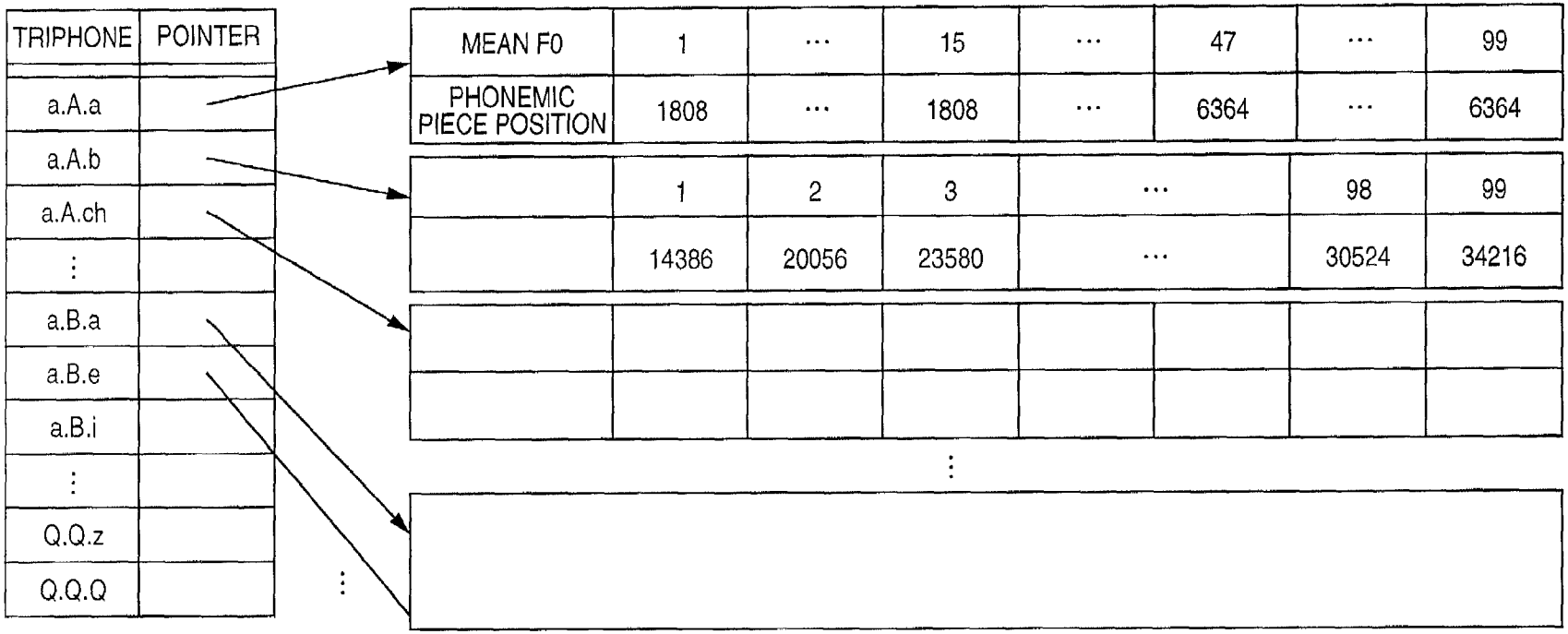
FIG. 9 is a view showing an index managed in the third embodiment of the present invention.

In step S15, the portions between sorted phonemic piece data are interpolated. In step S7*b*, the interpolated phonemic piece data are registered in correspondence with triphones ptr. As a result of registration, an index indicating the correspondence between the generated phonemic piece data and the triphones is formed as shown in FIG. 9. In addition, as shown in FIG. 9, in the pointers managed in correspondence with the triphones, "phonemic piece position" indicating the location of each phonemic piece data in the database 101*a* and "mean F0" are managed in the form of a table.

Steps S1 to S7*b* are repeated for all possible triphones. It is then checked in step S8*b* whether the processing for all the triphones is complete. If it is determined that the processing is not complete (NO in step S8*b*), the flow returns to step S1. If it is determined that the processing is complete (YES in step S8*b*), the processing is terminated.

As described above, according to the third embodiment, in addition to the effects obtained in the second embodiment, since the phonemic piece positions of all phonemic piece data are managed, the processing in step S11 in FIG. 4 can be simply implemented as the step of referring to a table. This can further simplify the processing.

Note that the present invention may be applied to either a system constituted by a plurality of equipments (e.g., a host computer, an interface device, a reader, a printer, and the like), or an apparatus consisting of a single equipment (e.g., a copying machine, a facsimile apparatus, or the like).

The objects of the present invention are also achieved by supplying a storage medium, which records a program code of a software program that can realize the functions of the above-mentioned embodiments to the system or apparatus, and reading out and executing the program code stored in the storage medium by a computer (or a CPU or MPU) of the system or apparatus.

In this case, the program code itself read out from the storage medium realizes the functions of the above-mentioned embodiments, and the storage medium which stores the program code constitutes the present invention.

As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiments may be realized not only by executing the readout program code by the computer but also by some or all of actual processing operations executed by an OS (operating system) running on the computer on the basis of an instruction of the program code.

Furthermore, the functions of the above-mentioned embodiments may be realized by some or all of actual processing operations executed by a CPU or the like arranged in a function extension board or a function extension unit, which is inserted in or connected to the computer, after the program code read out from the storage medium is written in a memory of the extension board or unit.

As many apparently widely different embodiments of the present invention can be made without departing from the spirit and scope thereof, it is to be understood that the invention is not limited to the specific embodiments thereof except as defined in the appended claims.

What is claimed is:

1. A speech synthesis apparatus having a database for managing phonemic piece data, comprising:

generating means for generating a first polyphone in consideration of a phonemic context for a phoneme as a search target;

search means for searching said database for a phonemic piece data corresponding to the first polyphone;

re-search means for generating a second polyphone by changing the phonemic context on the basis of the search result obtained by said search means, and re-searching said database for phonemic piece data corresponding to the second polyphone; and registration means for registering the search result obtained by said re-search means in a table in correspondence with the first polyphone.

2. The apparatus according to claim 1, wherein said registration means comprises calculation means for calculating an average fundamental frequency of phonemic piece data searched out by said search means or said re-search means, and sorting means for sorting the searched phonemic piece data group on the basis of the average fundamental frequency calculated by said calculation means, and registers the phonemic piece data group and the first polyphone in correspondence with each other according to an order in which the phonemic piece data group is sorted by said sorting means.

3. The apparatus according to claim 1, wherein the first polyphone is a triphone obtained in consideration of phonemic contexts of right and left phonemes of the phoneme.

4. The apparatus according to claim 1, wherein the second polyphone is a phoneme obtained in consideration of at least one of phonemic contexts of right and left phonemes of the phoneme.

5. The apparatus according to claim 1, wherein the second polyphone is a phoneme obtained in consideration of a left phonemic context of the phoneme when the phoneme is a vowel, and a right phonemic context of the phoneme when the phoneme is a consonant.

6. The apparatus according to claim 2, wherein said registration means further comprises quantization means for quantizing an average fundamental frequency of the searched phonemic piece data.

7. The apparatus according to claim 6, wherein said calculation means interpolates a frequency, of average fundamental frequencies of phonemic piece data groups quantized by said quantization means, for which no corresponding phonemic data is present by using an average fundamental frequency which is adjacent to the frequency and for which corresponding phonemic piece data is present.

8. A speech synthesis apparatus for performing speech synthesis by using phonemic piece data managed by a database, comprising:

storage means for storing a table for managing position information indicating a position of phonemic piece data in the database in correspondence with a phoneme obtained in consideration of a phonemic context made to correspond to the phonemic piece data;

calculation means for acquiring phonemic context information of the phoneme as a synthesis target and fundamental frequencies corresponding thereto and calculating an average of the acquired fundamental frequencies;

search means for searching a phoneme group corresponding to the phonemic context information from the table;

acquisition means for acquiring, from the table, position information of the phonemic piece data corresponding to a predetermined phoneme of the phoneme group searched by said search means, on the basis of the average of fundamental frequencies calculated by said calculation means; and changing means for acquiring the phonemic piece data indicated by the position information, acquired by said acquisition means from the database, and changing a prosody of the acquired phonemic piece data.

9. The apparatus according to claim 8, wherein said changing means changes the prosody by using a pitch synchronous waveform overlap adding method.

10. The apparatus according to claim 8, wherein when a fundamental frequency of a phoneme obtained in consideration of the phonemic context is quantized, said storage means manages the quantized fundamental frequency in the table in correspondence with position information indicating a position in the database at which phonemic piece data corresponding to the phoneme is present.

11. The apparatus according to claim 8, wherein when a fundamental frequency of a phoneme obtained in consideration of the phonemic context is quantized, said calculation means acquires phonemic context information of a phoneme as a synthesis target, and calculates an average of quantized fundamental frequencies of the phoneme group.

12. A control method for a speech synthesis apparatus having a database for managing phonemic piece data, comprising:

a generating step of generating a first polyphone in consideration of a phonemic context for a phoneme as a search target;

a search step of searching said database for a phonemic piece data corresponding to the first polyphone;

a re-search step of generating a second polyphone by changing the phonemic context on the basis of the search result obtained in said search step, and re-searching said database for phonemic piece data corresponding to the second polyphone; and a registration step of registering the search result obtained in said re-search step in a table in correspondence with the first polyphone.

13. The method according to claim 12, wherein said registration step comprises a calculation step of calculating an average fundamental frequency of phonemic piece data searched out in said search step or said re-search step; and a sorting step of sorting the searched phonemic piece data group on the basis of the average fundamental frequency calculated in said calculation step, and registering the phonemic piece data group and the first polyphone in correspondence with each other according to an order in which the phonemic piece data group is sorted in said sorting step.

14. The method according to claim 12, wherein the first polyphone is a triphone obtained in consideration of phonemic contexts of right and left phonemes of the phoneme.

15. The method according to claim 12, wherein the second polyphone is a phoneme obtained in consideration of at least one of phonemic contexts of right and left phonemes of the phoneme.

16. The method according to claim 12, wherein the second polyphone is a phoneme obtained in consideration of a left phonemic context of the phoneme when the phoneme is a vowel, and a right phonemic context of the phoneme when the phoneme is a consonant.

17. The method according to claim 13, wherein said registration step further comprises a quantization step of quantizing an average fundamental frequency of the searched phonemic piece data.

18. The method according to claim 17, wherein said calculation step comprises interpolating a frequency, of average fundamental frequencies of phonemic piece data groups quantized in said quantization step, for which no corresponding phonemic data is present by using an average fundamental frequency which is adjacent to the frequency and for which corresponding phonemic piece data is present.

19. A control method for a speech synthesis apparatus for performing speech synthesis by using phonemic piece data managed by a database, comprising:

a storage step of storing a table for managing position information indicating a position of phonemic piece data in the database in correspondence with a phoneme obtained in consideration of a phonemic context made to correspond to the phonemic piece data;

a calculation step of acquiring phonemic context information of the phoneme as a synthesis target and fundamental frequencies corresponding thereto and calculating an average of the acquired fundamental frequencies;

a search step of searching a phoneme group corresponding to the phonemic context information from the table;

an acquisition step of acquiring, from the table, position information of the phonemic piece data corresponding to a predetermined phoneme of the phoneme group searched in the search step, on the basis of the average fundamental frequencies calculated in said calculation step; and a changing step of acquiring the phonemic piece data indicated by the position information acquired in said acquisition step from the database, and changing a prosody of the acquired phonemic piece data.

20. The method according to claim 19, wherein said changing step comprises changing the prosody by using a pitch synchronous waveform overlap adding method.

21. The method according to claim 19, wherein when a fundamental frequency of a phoneme obtained in consideration of the phonemic context is quantized, said storage step comprises managing the quantized fundamental frequency in the table in correspondence with position information indicating a position in the database at which phonemic piece data corresponding to the phoneme is present.

22. The method according to claim 19, wherein when a fundamental frequency of a phoneme obtained in consideration of the phonemic context is quantized, said calculation step comprises acquiring phonemic context information of a phoneme as a synthesis target, and calculating an average of quantized fundamental frequencies of the phoneme.

23. A computer-readable memory storing program codes for controlling a speech synthesis apparatus having a database for managing phonemic piece data, comprising:

a program code for a generating step of generating a first polyphone in consideration of a phonemic context for a phoneme as a search target;

a program code for a search step of searching said database for a phonemic piece data corresponding to the first polyphone;

a program code for a re-search step of generating a second polyphone by changing the phonemic context on the basis of the search result obtained in the search step, and re-searching said database for phonemic piece data corresponding to the second polyphone; and a program code for a registration step of registering the search result obtained in the re-search step in a table in correspondence with the first polyphone.

24. A computer-readable memory storing program codes for controlling a speech synthesis apparatus for performing speech synthesis by using phonemic piece data managed by a database, comprising:

a program code for a storage step of storing a table for managing position information indicating a position of phonemic piece data in the database in correspondence with a phoneme obtained in consideration of a phonemic context made to correspond to the phonemic piece data;

a program code for a calculation step of acquiring phonemic context information of the phoneme as a synthesis target and fundamental frequencies corresponding thereto and calculating an average of the acquired fundamental frequencies;

a program code for a search step of searching a phoneme group corresponding to the phonemic context information from the table;

a program code for an acquisition step of acquiring, from the table, position information of the phonemic piece data corresponding to a predetermined phoneme of the phoneme group searched in the search step, on the basis of the average of fundamental frequencies calculated in the calculation step; and a program code for a changing step of acquiring the phonemic piece data indicated by the position information acquired in the acquisition step from the database, and changing a prosody of the acquired phonemic piece data.

25. A speech synthesis apparatus having a database for managing phonemic piece data, comprising:

generating means for generating a polyphone in consideration of a phonemic context for a phoneme as a search target;

search means for searching said database for a phonemic piece data corresponding to the polyphone;

re-search means for re-searching said database for phonemic piece data corresponding to the phoneme; and registration means for registering the search result obtained by said re-search means in a table in correspondence with the polyphone.

26. A control method for a speech synthesis apparatus having a database for managing phonemic piece data, comprising:

a generating step of generating a polyphone in consideration of a phonemic context for a phoneme as a search target;

a search step of searching said database for a phonemic piece data corresponding to the polyphone;

a re-search step of re-searching said database for phonemic piece data corresponding to the phoneme; and a registration step of registering the search result obtained by said re-search step in a table in correspondence with the polyphone.

27. A computer-readable memory storing program codes for controlling a speech synthesis apparatus having a database for managing phonemic piece data, comprising:

a program code for a generating step of generating a polyphone in consideration of a phonemic context for a phoneme as a search target;

a program code for a search step of searching said database for a phonemic piece data corresponding to the polyphone;

a program code for a re-search step of re-searching said database for phonemic piece data corresponding to the phoneme; and a program code for a registration step of registering the search result obtained by said re-search step in a table in correspondence with the polyphone.

* * * * *